US006269287B1

(12) United States Patent
March

(10) Patent No.: US 6,269,287 B1
(45) Date of Patent: Jul. 31, 2001

(54) METHOD AND APPARATUS FOR MONITORING A HYDROELECTRIC FACILITY TRASH RACK AND OPTIMIZING PERFORMANCE

(75) Inventor: Patrick A. March, Maryville, TN (US)

(73) Assignee: Tennessee Valley Authority, Muscle Shoals, AL (US)

( * ) Notice: Subject to any disclaimer, the term of this patent is extended or adjusted under 35 U.S.C. 154(b) by 0 days.

(21) Appl. No.: 09/144,809

(22) Filed: Sep. 1, 1998

Related U.S. Application Data

(63) Continuation-in-part of application No. 08/700,316, filed on Aug. 19, 1996, now Pat. No. 5,800,077.

(51) Int. Cl.[7] ..... H02J 1/14
(52) U.S. Cl. ..... 700/287; 700/286; 405/87
(58) Field of Search ..... 700/287, 289, 700/292, 83; 405/60, 74, 78, 80, 81, 87, 92, 125; 702/50

(56) References Cited

U.S. PATENT DOCUMENTS

| | | | | |
|---|---|---|---|---|
| 3,932,735 | | 1/1976 | Giras | 700/287 |
| 4,075,699 | | 2/1978 | Schneider et al. | 700/291 |
| 4,234,925 | | 11/1980 | Kitano et al. | 700/287 |
| 4,255,787 | * | 3/1981 | Hoffmann et al. | 700/287 |
| 4,319,320 | | 3/1982 | Sato et al. | 700/45 |
| 4,328,556 | | 5/1982 | Abe et al. | 700/23 |
| 4,486,381 | | 12/1984 | Koji et al. | 376/210 |
| 4,683,718 | | 8/1987 | Larsson | 91/178 |
| 4,755,690 | * | 7/1988 | Obermeyer | 290/52 |
| 4,770,843 | | 9/1988 | Taleyarkhan | 376/216 |
| 4,772,157 | | 9/1988 | Obermeyer | 405/75 |
| 4,788,647 | | 11/1988 | McManus et al. | 700/287 |
| 4,794,544 | | 12/1988 | Albright et al. | 700/287 |
| 4,823,018 | | 4/1989 | Kuwabara et al. | 290/7 |
| 4,994,684 | | 2/1991 | Lauw et al. | 290/52 |
| 5,322,412 | | 6/1994 | Erlach | 415/1 |
| 5,347,446 | | 9/1994 | Iino et al. | 700/29 |
| 5,402,332 | | 3/1995 | Kopf | 700/29 |
| 5,825,094 | * | 10/1998 | Hess | 290/54 |

OTHER PUBLICATIONS

Daugherty et al., Fluid Mechanics with Engineering Application, 8th Edition, McGraw–Hill, Inc. pp. 231–240, 1985.

* cited by examiner

*Primary Examiner*—Paul P. Gordon
*Assistant Examiner*—Chad Rapp
(74) *Attorney, Agent, or Firm*—Foley & Lardner

(57) ABSTRACT

A system and method are provided for monitoring trash rack fouling in a turbine facility. The trash rack monitoring system includes sensors for detecting apparent gross head, flow rate, and effective gross head. The head values are used to select performance curves representative of historical turbine operation at the two head values. The two performance curves are simultaneously displayed on a computer monitor to graphically depict the decreased turbine performance resulting from fouling of the trash racks. The performance is also shown as an economic loss value. A method is also provided for optimizing performance in a multi-unit turbine facility. The method involves determining the net head on each turbine unit as a basis for selecting net head performance curves and ultimately deriving an optimum operating point for each turbine unit.

22 Claims, 7 Drawing Sheets

METHOD AND APPARATUS FOR MONITORING A HYDROELECTRIC FACILITY TRASH RACK AND OPTIMIZING PERFORMANCE

RELATED APPLICATIONS

This application is a continuation in part of U.S. Ser. No. 08/700,316, filed Aug. 19, 1996, which is now U.S. Pat. No. 5,800,077, issued Sep. 1, 1998.

TECHNICAL FIELD

The present invention relates generally to ameliorating performance of a hydroelectric facility through improved monitoring of the fouling of the facility trash rack. In particular, the invention relates to detecting parameters indicative of losses across the trash rack and utilizing these parameters to determine when the losses reach unacceptable levels, indicating that corrective measures, such as manual or automatic cleaning of the rack, should be undertaken.

BACKGROUND OF THE INVENTION

It is common practice in the art of hydroelectric power generation to provide a debris screening structure, commonly referred to as a trash rack, upstream of turbine intake conduits to stop large objects from entering into the conduits and potentially fouling or damaging the turbine machinery. Such trash racks are typically formed of a series of vertical or inclined, parallel pipes or bars anchored to the upstream face of a dam, or to the base of the dam, and extending to a height which may be above the headwater elevation. Objects and debris flowing with stream currents and pulled toward the intake conduits are stopped by the rack and retained upstream until physically removed by manual or mechanized rakes or other cleaning equipment.

A problem with conventional trash rack installations is their tendency to accumulate significant quantities of debris, ultimately resulting in operational problems associated with partial or complete trash rack failure (e.g., collapse) or significant head losses that negatively impact the productivity of the power generating facility. This negative impact is felt in terms of reduced power production, reduced operability, reduced availability and, consequently, in terms of lost revenue. For example, it is estimated that at one 5-turbine unit 175 MW river hydroelectric plant, trash rack losses of one foot of head represent an annual revenue loss of $500,000.00 at an energy value of $25.00 per MWh.

While various systems have been proposed for monitoring head losses across trash racks, these have not proven entirely satisfactory. For example, existing techniques do not accurately reflect real losses across the trash rack as flow rate through the rack changes, making loss data difficult to interpret. Moreover, known systems have not been integrated effectively in an overall control scheme designed to inform and alert operations personnel of the need to clean the trash rack, typically relying on spot checking or periodic cleaning schedules.

Another problem can arise in optimizing performance in a multi-unit hydro turbine plant. While a few systems are known for optimizing performance in multi-unit plants (e.g., distributing the loads among the turbine units to operate the plant as efficiently as possible or to generate a desired base load as efficiently as possible) including units of various capacities and efficiencies, the optimization systems heretofore all have based the analysis on assumed operating efficiencies of the turbine. However, when the various turbine units have unknown or differing amounts of trash build-up, the assumed operating efficiencies can no longer be assumed to apply. Thus, any optimization solution which fails to take this fact into account will not be an ideal distribution.

There is a need, therefore, for an improved system for monitoring fouling of trash racks in hydroelectric facilities, and for informing plant personnel or automated control systems of the real state of losses across the rack, both in terms of head loss and in terms of economic impact. There is also a need for an improved system for informing operations engineering and management personnel, or automated control systems, of the potential for trash rack failure due to excessive head losses. There is further a need for an improved multi-unit optimization method and system which accounts for varying amounts of trash build-up on the turbine units.

SUMMARY OF THE INVENTION

The present invention features novel techniques for monitoring and displaying trash rack fouling in a turbine facility and for optimizing performance in a multi-unit turbine facility. The techniques are applicable to all types of turbine facilities and may be applied to existing equipment.

In accordance with a first aspect of the invention, a method is provided for optimizing performance in a hydroelectric power generation facility including a plurality of turbine driven power generating units. Each turbine unit in the facility receives flow through an upstream conduit, and a trash rack is disposed upstream of the conduit to prevent debris from flowing into the unit. First, a net head is determined for each turbine unit. Next, a net head performance curve is selected for each turbine unit based on the net head associated therewith. Based on the selected net head performance curves, an optimum operating point is then derived for each turbine unit.

The invention also includes a method for monitoring losses in a hydroelectric power generation facility. The facility includes a turbine driven power generating unit which receives flow through an upstream conduit, and a trash rack is disposed upstream of the conduit to prevent debris from flowing into the unit. First, a total gross head and an effective gross head are determined for the turbine unit. Then, a best performance curve is selected based on the total gross head and an actual performance curve is selected based on the effective gross head. Next, the best performance curve and the actual performance curve are simultaneously displayed on an operator interface or provided to an automated control system.

The invention also provides a system for monitoring losses in a hydroelectric power generation facility of the type mentioned above. The system includes a plurality of sensors coupled to a controller and an operator interface coupled to the controller. A first sensor detects a first parameter representative of head upstream of the trash rack and generates a first signal representative thereof. A second sensor detects a second parameter representative of head downstream of the trash rack and generates a second signal representative thereof. The controller processes the first and second signals to generate first and second performance curves. The first performance curve is representative of turbine operation at the head upstream of the trash rack, and the second performance curve is representative of turbine operation at the head downstream of the trash rack. The controller commands the operator interface to display the first and second performance curves overlaid on each other.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
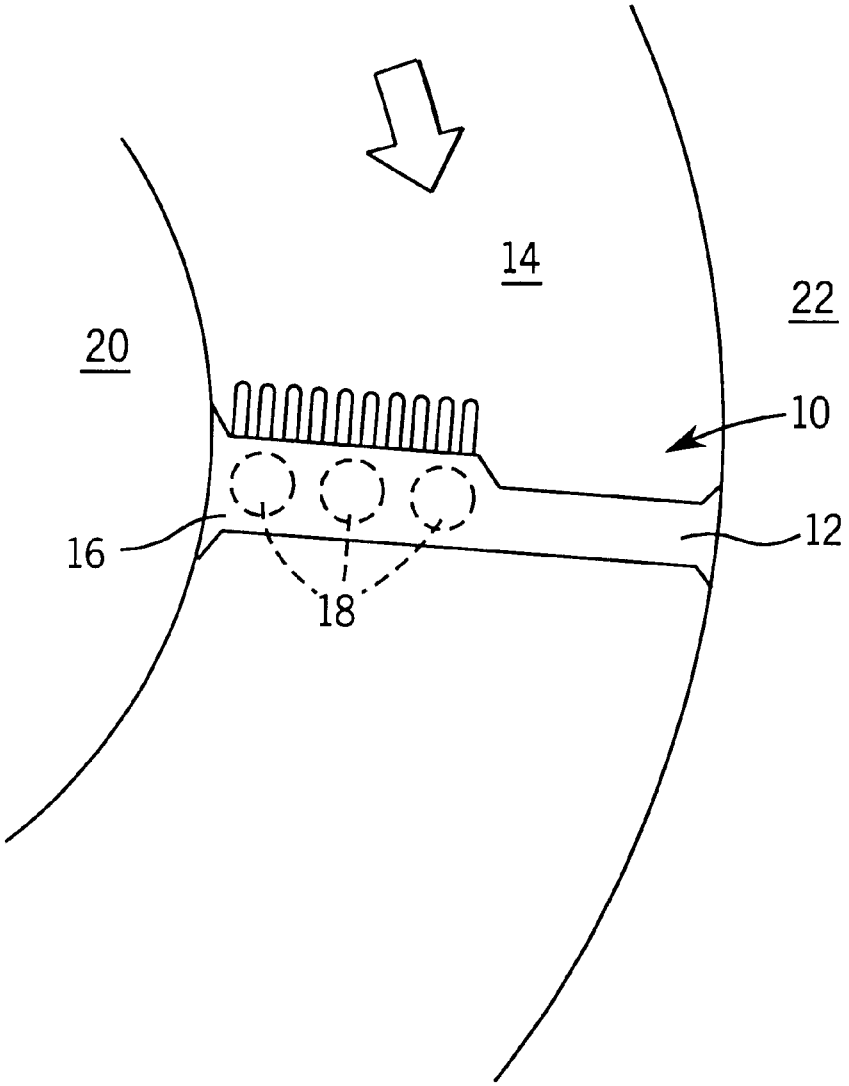
FIG. 1 is an exemplary perspective view of a turbine power generating facility including several turbine units across a section of a stream.

Turning now to the drawings and referring to FIG. 1, a hydroelectric power generating installation 10 is illustrated generally, including a dam 12 spanning a stream 14, and a power generating facility 16. In the exemplary installation illustrated, facility 16 includes a series of three Kaplan turbine generating units, designated generally by the reference numeral 18. As will be understood by those skilled in the art, facility 16 may include more or fewer generating units 18, and such units may be situated adjacent to one or both banks 20, 22 of stream 14, or at various locations between the banks. Moreover, while the following discussion makes reference to a Kaplan turbine by way of example, the present invention is not limited to application with any particular type of turbine unit. In operation, facility 16 generates electrical power by permitting water to flow through turbine units 18, and outputs the generated power on a power distribution grid (not represented).

Figure 2:
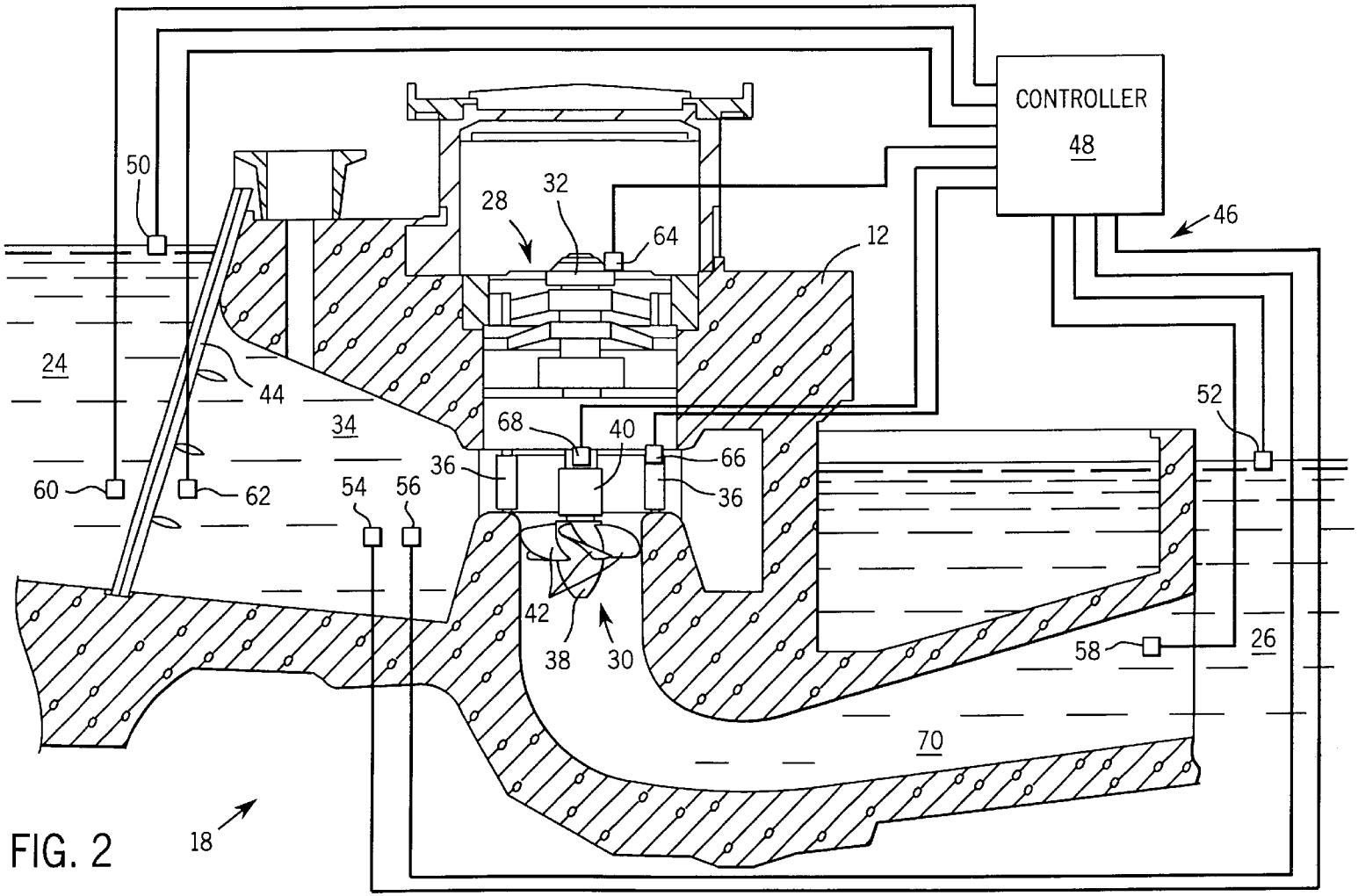
FIG. 2 is a diagrammatical representation of a turbine installation illustrating exemplary instrumentation for monitoring losses across a trash rack in accordance with the invention.

Each turbine unit 18 may be of generally known design, such as the vertical Kaplan turbine as illustrated diagrammatically in FIG. 2, for generating electrical power as water is allowed to flow through dam 12 from a headwater reservoir 24 of stream 14 to a tailwater side 26. Thus, unit 18 includes a turbine support superstructure 28 built within dam 12. Superstructure 28 provides axial and radial support for a turbine 30 and electrical generator 32. For the illustrated power generating unit, turbine 30 is positioned within the flow path of stream 14, downstream of an inlet conduit 34 and movable wicket gates 36. Turbine 30 includes a runner 38 supported on a vertical shaft 40 and having a plurality of movable blades 42 disposed around its periphery for driving shaft 40 and generator 32 in rotation as water flows through dam 12 from headwater 24 to tailwater 26. Unit 18 also includes a trash rack 44 upstream of inlet conduit 34, typically comprising parallel, spaced-apart bars, for preventing large objects and debris from fouling or damaging turbine 30. A mechanical cleaning system may be provided atop superstructure 28 for removing debris accumulated upstream of trash rack 44. Alternatively, facility 16 may employ manual methods (e.g., rakes) for removing debris from trash rack 44 when required.

In the preferred embodiment illustrated in FIG. 2, unit 18 includes a control system, designated generally by the reference numeral 46, including a number of sensors 50, 52, 54, 56, 58, 60, 62 and 64 and actuators 66 and 68 coupled to a controller 48 by appropriate data links. For the purpose of controlling operation of unit 18 and monitoring losses across trash rack 44, the sensors of control system 46 preferably permit detection of a set of operating parameters, including differential head from headwater 24 to tailwater 26, power generation level, flow through unit 18, cavitation, and trash rack head loss. While a number of alternative method are known in the art for directly or indirectly measuring these parameters, preferred sensing devices include the following. Stilling well-type transducers 50 and 52 measure the relative elevation or height of headwater and tailwater 24 and 26, respectively. Such measurements are used to determine the drop in head across dam 12 and for determining the submersion factor ($\alpha$) of the turbine as an indication of the risk of cavitation within turbine 30. The submersion level is generally determined as a function of the difference between the tailwater elevation and a reference elevation for turbine 30 in a manner well known in the art. Sensor 54, positioned, where feasible within inlet conduit 34, is a pressure transducer providing a signal proportional to head upstream of turbine 30, accounting for head losses between headwater 24 and wicket gates 36. Where unit 18 has a relatively short inlet conduit 34, sensor 54 may be situated near its entry. Reference numeral 56 represents a sensor assembly positioned within inlet conduit 34 for generating a signal indicative of flow through unit 18. In the preferred embodiment, flow is determined by the well known Winter-Kennedy method, although alternative methods could be substituted, including the Peck method. Sensor 58, provided in the draft tube 70 of unit 18, is a pressure transducer similar to sensor 54 generating a pressure measurement signal and isolating losses from turbine 30 to tailwater 26. Sensors 60 and 62 are pressure transducers generating pressure measurements on either side of trash rack 44, and providing an indication of head loss across trash rack 44. Alternatively, trash rack losses could be indicated by measurements of headwater level (e.g., from sensor 50) and inlet head (e.g., from sensor 54). Finally, reference numeral 64 represents a power monitor providing a continuous signal indicative of the level of power being generated by unit 18.

In addition to the sensors described above, control system 46 is typically provided with actuator assemblies 66 and 68 for orienting gates 36 and blades 42 at desired positions. Actuator assemblies 66 and 68 may be of any suitable type known in the art, such as assemblies including hydraulic cylinders or motors coupled to mechanical linkages for effectuating the desired movement of the gates and blades and for holding the gates and blades in the desired positions against the force of impinging flow through unit 18. Moreover, actuator assemblies 66 and 68 also include sensors, such as potentiometers, linear variable differential transformers or the like, for providing feedback signals indicative of the actual positions of gates 36 and blades 42.

Signals from the various sensors outlined above are applied to controller 48, which also serves to generate control signals for commanding actuator assemblies 66 and 68 to position gates 36 and blades 42 in desired orientations. In the presently preferred embodiment, controller 48 includes an appropriately configured programmable logic controller executing a cyclic control routine stored in resident memory. Moreover, controller 48 is preferably also linked to other turbine units 18 within facility 16. Thus, where the other units 18 within facility 16 are comparably instrumented, controller 48 receives signals indicative of the operating parameters of all units 18 in facility 16, and controls operation of all gates and blades in the various units.

For the particular purpose of monitoring losses across trash rack 44, facility 16 is preferably instrumented as follows. When the structure of facility 16 permits, it is preferred to measure differential head across trash rack 44 via sensors 60 and 62 located as closely adjacent to trash rack 44 as possible to isolate the effects of other (i.e., non-trash rack) losses. In some facilities, however, it may be acceptable or necessary to base estimates of trash rack losses on headwater level (as measured by sensor 50) and on an output of a suitable piezometer positioned within inlet conduit 34. Ultimately, however, when the present technique and system are retrofitted to existing facilities, the particular instrumentation options may be limited by the facility design. As discussed below, the present technique should not be considered to be limited to any particular instrumentation, but more generally requires some form of instrumentation for detecting pressure drop across trash rack 44 and flow through inlet conduit 34.

Figure 3:
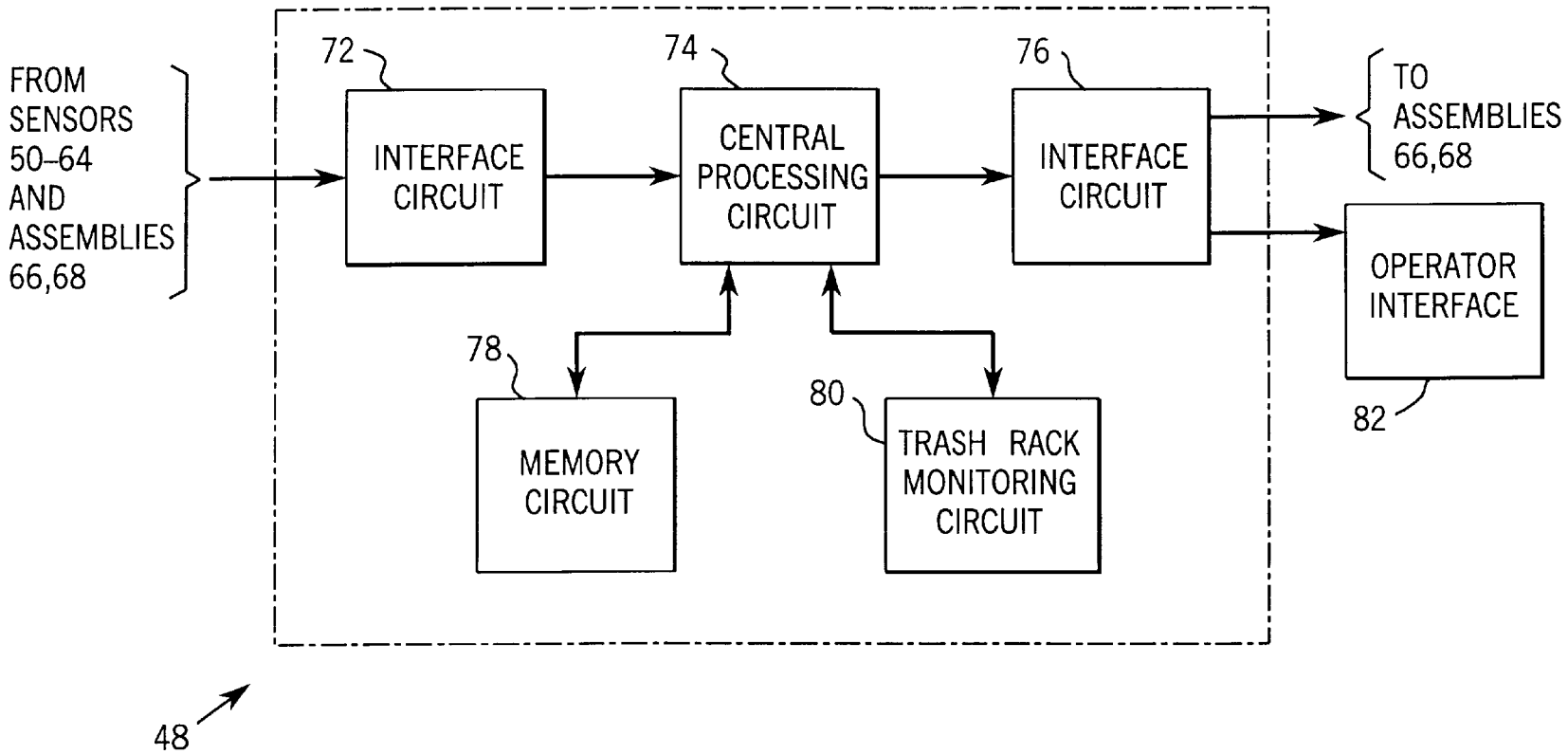
FIG. 3 is a block diagram of certain of the functional circuits in the control system illustrated in FIG. 2 for monitoring and analyzing trash rack losses.

FIG. 3 is a general block diagram of certain functional circuits included in controller 48 when programmed to execute a trash rack loss monitoring technique as described below. Controller 48 includes an interface circuit 72, a central processing circuit 74, an interface circuit 76, a memory circuit 78 and a trash rack monitoring circuit 80. Interface circuit 72, which typically includes appropriate multiplexing, analog-to-digital converting and signal conditioning circuitry receives operating parameter signals from sensors 50–64 and feedback signals from actuator assemblies 66 and 68, and applies these signals to central processing circuit 74. Similarly, interface circuit 76, which typically includes appropriate signal conditioning circuitry, receives control signals from central processing circuit 74 and commands corresponding servo movement of gates 36 and blades 42. Moreover, interface circuit 76 communicates control signals from central processing circuit 74 to an operator interface 82 for displaying operating conditions, such as the head loss across trash rack 44 or a cost value associated with current trash rack losses. Operator interface 82, which will typically include a computer monitor situated in a control station (not shown) for facility 16 may also display or sound visual or audible alarms, such as when trash rack losses exceed predetermined threshold levels as described below.

Central processing circuit 74 is also linked to memory circuit 78 and trash rack monitoring circuit 80. In operation, central processing circuit 74 executes a cyclical control routine stored within memory circuit 78 for controlling operation of facility 16. As described more fully below, based upon the head and flow related signals applied to central processing circuit 74, trash rack monitoring circuit 80 generates trash rack loss values and communicates these values to central processing circuit 74.

As will be appreciated by those skilled in the art, the functional circuitry represented in FIG. 3 may be defined by standard input/output circuitry, memory circuitry and programming code in a standard programmable logic controller, personal computer, computer workstation or the like. For example, in the presently preferred embodiment, central processing circuit 74, in the form of a programmable logic controller dedicated to facility 16, is provided with resident memory for executing a main control routine. Trash rack monitoring circuit 80 is preferably a portion of the main control routine, or may comprise a separate software module retrofitted to the main control routine.

In accordance with a preferred embodiment of the invention, controller 48 calculates losses across trash rack 44 as follows. When sensors 60 and 62 are available in facility 16 for detecting parameters representative of the pressure differential across trash rack 44, trash rack monitoring circuit 80 calculates a trash rack head loss parameter or coefficient in accordance with the relationship:

$$K_T=2g(A_T)^2(H_1-H_2)/Q^2 \quad (1);$$

where $K_T$ is the trash rack loss parameter, g is a gravitational constant, $A_T$ is an intake flow area for the trash rack, $H_1$ is the head immediately upstream from the trash rack, $H_2$ is the head immediately downstream from the trash rack and Q is the intake volumetric flow rate. Referring to the diagrammatical view of FIG. 2, the intake flow area utilized in equation 1 will be known for facility 16 and generally corresponds to the cross sectional area of the inlet conduit at the location of sensor 62. As mentioned above, the flow rate through the inlet conduit may be measured or calculated in a variety of known ways, such as the Winter-Kennedy method.

When facility 16 includes net head taps or other suitable piezometer instrumentation in inlet conduit 34 downstream of trash rack 44, the trash rack head loss coefficient may be calculated using the headwater elevation as detected by sensor 50, in accordance with the relationship:

$$K_I=2g(A_T/Q)^2(HW-H_3)-(A_T/A_I)^2(1+K_I) \quad (2);$$

where HW is the headwater elevation, $A_I$ is the inlet conduit flow area at the location of the head tap or piezometer, $H_3$ is the piezometric head in the inlet conduit and $K_I$ is an intake loss coefficient representative of losses between a point adjacent to the trash rack (e.g., the location of sensor 62) and the location of the piezometer. The latter coefficient is preferably measured for the particular installation or may be predicted analytically in a manner known by those skilled in the art.

The resulting trash rack loss coefficients provide an indication of head loss across trash rack 44 independent of flow through the trash rack. Trash rack monitoring circuit 80 preferably determines the trash rack coefficient periodically and communicates the resulting coefficient to circuit 74 for storage in memory circuit 78. By accessing historical trash rack coefficients thus stored in memory circuit 78, circuit 74 may output trending values to operator interface 82, such as for graphically displaying losses due to trash buildup over time. Moreover, trash rack monitoring circuit 80 preferably generates a reference trash rack loss coefficient when trash rack 44 is clean. Subsequently, by comparing current coefficient values to the reference clean value, controller 48 preferably determines a cost value associated with additional head loss across the trash rack due to fouling. This cost value R is preferably generated in accordance with the relationship:

$$R=[(K_T-K_C)(Q/A_T)^2PE]/[2g(HW-TW)_{avg}] \quad (3);$$

where $K_C$ is an intake loss coefficient for the trash rack when clean, P is the average annual energy production for the facility, E is an economic energy unit cost, and $(HW-TW)_{avg}$ is the average gross head for the facility. In general, the average annual energy production and average gross head will be known for facility 16. The unitary energy cost may be estimated based upon an average value or may be accessed in real time, such as via a wide area network, modem or other telecommunications link. In the latter case, the unit cost value may change over time, reflecting the current market value for energy produced by the facility. By periodically calculating this cost value and storing successive values in memory circuit 78, controller 48 may display trending plots for current and accumulated costs of trash rack fouling on operator interface 82.

In addition to the costing function of the present technique, controller 48 preferably stores a threshold value for the trash rack coefficient or the cost value and periodically compares the current value for the coefficient or cost value to the threshold value. The threshold value, corresponding to a limit of acceptable trash rack losses, will typically be set by operations personnel based upon desired performance of the facility. When the current value of the coefficient or cost value exceeds the reference level, controller 48 will output a signal to operator interface 82 to produce a visual or audible alarm signaling the need to clean the trash rack or, in the more extreme case, a higher order alarm or unit shutdown command signal may be output. Such comparisons may also serve as a basis for engaging an automatic cleaning system to remove debris from the trash rack.

Figure 4:
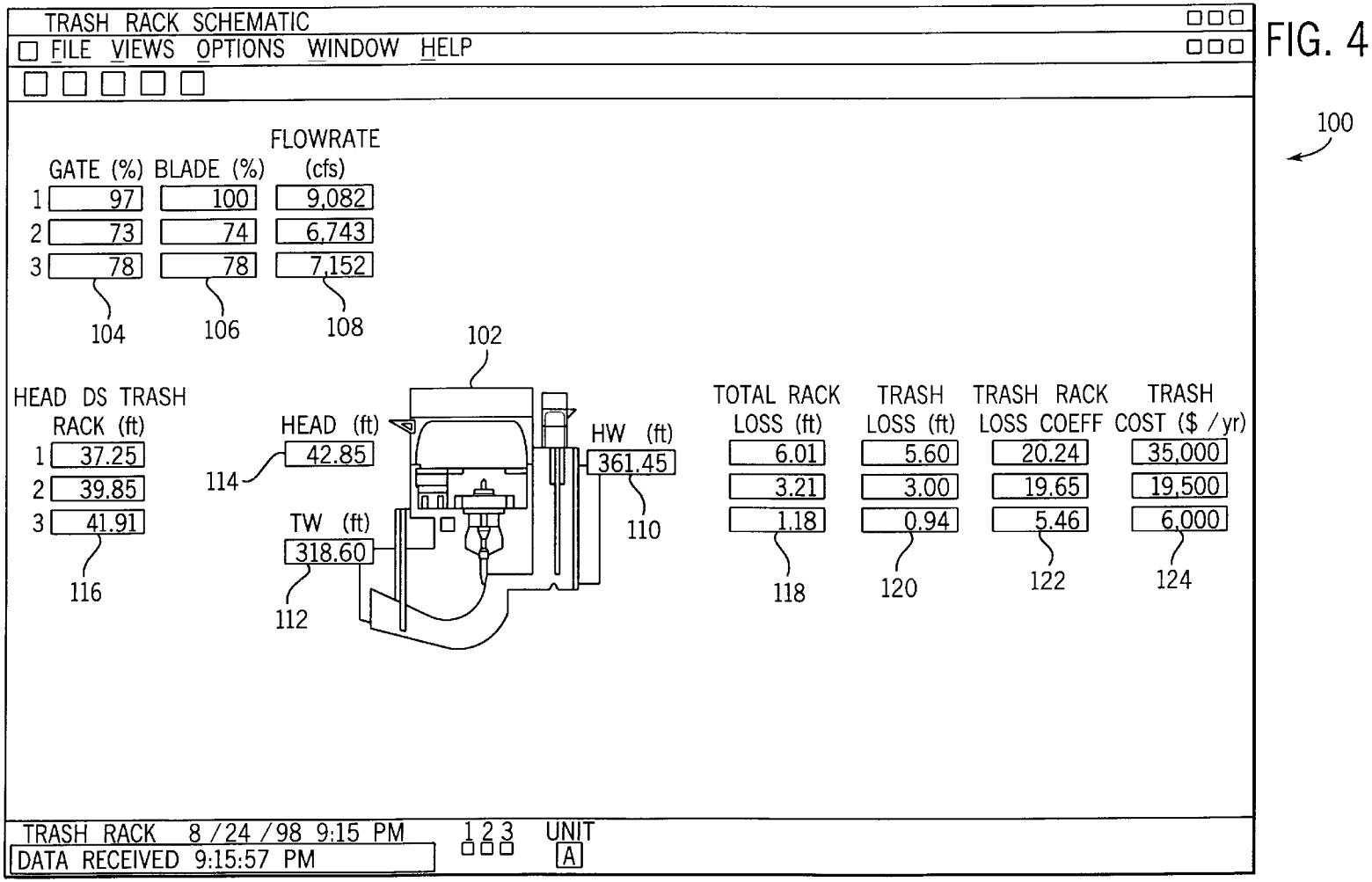
FIG. 4 is an exemplary view of computer display screen showing a graphic representation of a hydro turbine and associated data of several turbine units for informing plant personnel of the real state and economic costs of losses across the trash racks.

As mentioned above, operator interface 82 will typically include a computer monitor for displaying trash loss information of interest to an operator. FIG. 4 is a Trash Rack Schematic view 100 including a graphic representation 102 of a hydro turbine and data displays 104–124 showing basic data for trash rack monitoring circuit 80. The data displays 104–124 are preferably located at points near or relative to graphic image 102 that visually relate the data to the measurement points on the equipment. Alternatively, the data could be presented in a simple tabular format or in some other useful arrangement.

Data displays 104–108 comprise three columns in the upper left corner of view 100 and show basic data relating to the operation of the facility. In particular, displays 104, 106 and 108 show respectively the current gate positions, blade positions, and flow rates of the three turbine units 1, 2 and 3, which data may be determined as described above. Data displays 110–114 are centrally located in view 100 around graphic image 102 and show basic operating data common to all of the turbine units. In particular, data displays 110, 112 and 114 show respectively the headwater level, tailwater level, and apparent or total gross head (i.e., the difference between the headwater and tailwater levels), which also may be determined as described above. Data display 116 is a column on the left side of view 100 (i.e., the downstream side of graphic image 102) which shows the actual (i.e., effective or net) gross head measured downstream of the trash rack for each of the turbine units 1, 2 and 3. Data displays 118–124 comprise four columns on the right side of view 100 (i.e., the upstream side of graphic image 102) which show the trash rack losses and costs for the turbine units. More specifically, displays 118, 120, 122 and 124 show respectively the total trash rack loss (i.e., head loss due to trash rack and trash), trash loss (i.e., head losses due to trash alone), trash rack loss coefficient $K_T$, and trash cost R for the three turbine units, which data also may be determined as described above. The trash loss for each turbine unit is the common apparent gross head (i.e., data display 114) minus the associated actual head (i.e., display 116). Thus, although the turbine units share an apparent gross head, each turbine unit will typically have a different net head because of the different amount of trash on each.

The trash cost shown in display 124 is the extra cost of operation just due to the head loss from the trash, i.e., not including head loss from the trash rack itself and not accounting for any efficiency loss due to operating the turbine at a lower effective gross head (explained below with reference to FIGS. 5A–5C). Preferably, display 124 is user selectable such that trash costs may be expressed in dollars per hour, day, week, month, or year. Dollars per hour and dollars per day are particularly useful to an operator who can directly compare that dollar amount to the cost of having workers spend a shift cleaning the trash racks. On the other hand, expressing trash costs on a per year basis provides better appreciation (e.g., as a training function) of the full economic impact of operating with dirty trash racks.

Figure 5A:
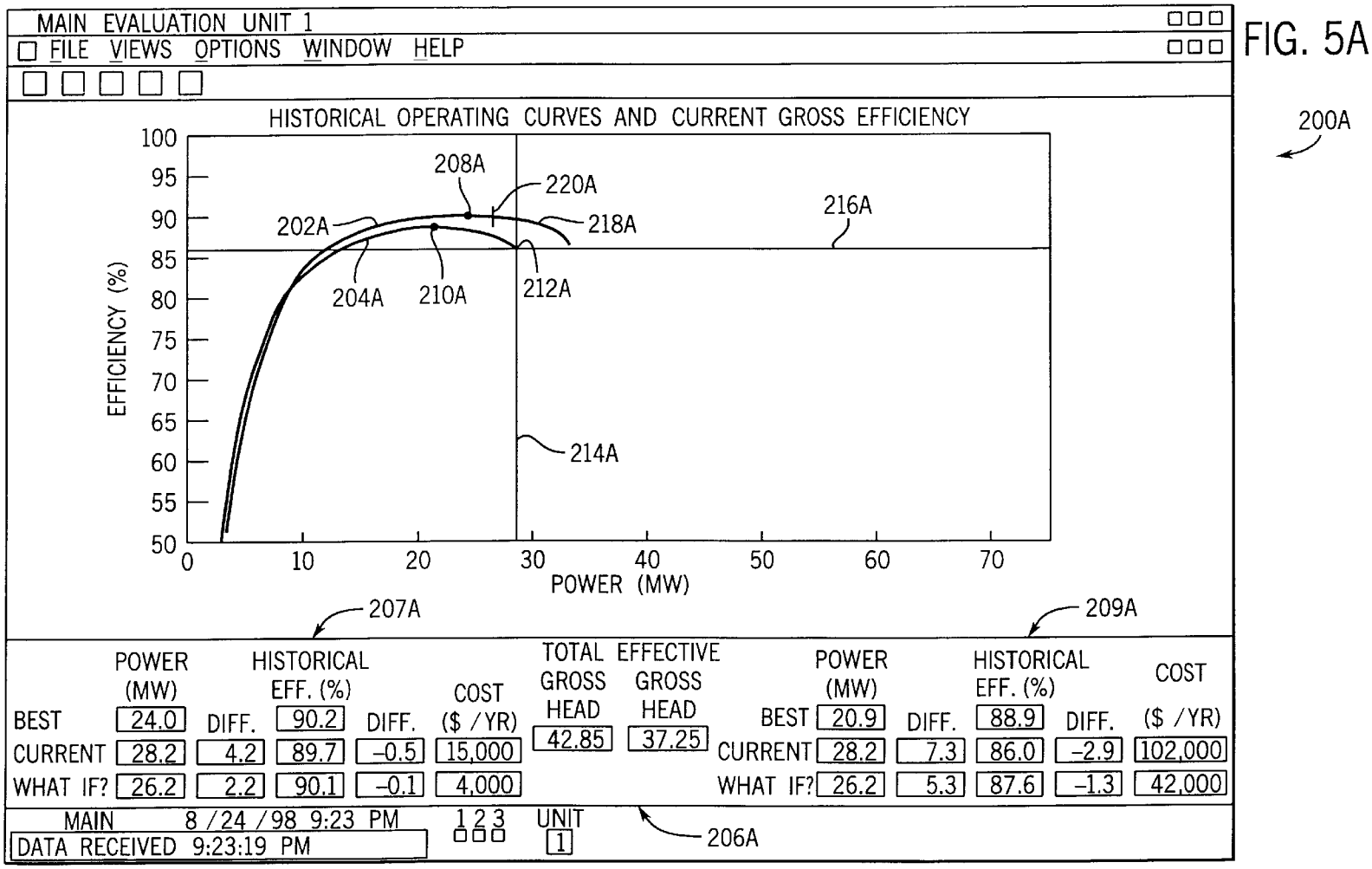
FIGS. 5A–5C are exemplary views of computer display screens showing graphical and textual information for monitoring and analyzing trash rack losses in a power generating facility including several turbine units.

FIG. 5A is a Main Evaluation Unit 1 view 200A which provides an operator with a graphical impression of the real-time trash loss occurring on turbine unit 1. View 200A includes upper and lower performance curves 202A and 204A as well as a data display area 206A. To visually distinguish the two curves, upper curve 202A is preferably a thicker line than lower curve 204A. Alternatively or in addition, the two curves could be drawn in different colors. Performance curves 202A and 204A are each selected from a series of operating curves as a function of head which are computed ahead of time and stored in memory 78. Thus, when the head on turbine unit 1 changes, performance curves 202A and 204A in view 200A also change. One skilled in the art can generate a family of performance curves as a function of head from a finite number of points obtained by a suitable technique, such as model testing, index testing, and/or absolute efficiency testing. Additionally, one skilled in the art will know that the curves stored in memory 78 for each family can be used to further generate an indefinite number of curves over a range by known mathematical relationships, e.g., affinity laws which allow scaling from one curve to another.

Upper performance curve 202A is an operating curve of turbine unit 1 with a completely clean trash rack, i.e., curve 202A is a gross head curve. Since total gross head is simply the difference between the upstream water level and the downstream level (i.e., 42.85 feet as illustrated), curve 202A represents the best possible performance of unit 1. Data display area 206A includes performance data corresponding to gross head curve 202A in a gross head curve data area 207A on the left side of area 206A.

Lower performance curve 204A is the actual operating curve of turbine unit 1 with a dirty trash rack, i.e., curve 204A is a net (or effective gross) head curve. Since net head is the total gross head minus any head loss resulting from the trash and trash rack, curve 204A represents the actual performance of unit 1. Data display area 206A includes performance data corresponding to net head curve 204A in a net head curve data area 209A on the right side of area 206A.

View 200A preferably includes a number of features of interest to an operator who must make decisions based on the operational efficiency of the plant, such as whether or not to clean the trash racks. Alternatively or in addition, the features described below could be used in combination with an automated control system which makes similar decisions. For example, one preferable feature in view 200A is an indication of the most efficient operating points on performance curves 202A and 204A, such as respective circular dots 208A and 210A in FIG. 5A. The exact locations of dots 208A and 210A on respective curves 202A and 204A, as well as the corresponding "best" data in the top row of display area 206A, are preferably computed by the algorithm that does the curve fit. As illustrated, the most efficient operating point (indicated by dot 208A) for turbine unit 1 with a clean trash rack and 42.85 feet of total gross head is at a power level of 24.0 MW, which historically is 90.2% efficient. Similarly, the most efficient operating point (indicated by dot 210A) for turbine unit 1 with a dirty trash rack and 37.25 feet of effective gross head is at a power level of 20.9 MW, which historically is 88.9% efficient.

Another preferable feature in view 200A is an indication of the efficiency costs of operating turbine unit 1 at the current operating (or power) level. In view 200A, turbine unit 1 has a dirty trash rack and is currently operating at a point 212A on actual curve 204A indicated by a cross-hair (formed by a vertical line 214A and a horizontal line 216A, preferably drawn in a color such as green). As illustrated, turbine unit 1 is operating well beyond its cavitation limit, at a point called maximum sustainable load, which represents a typical operating point when power demand is high and the power price is high. Vertical line 214A extends upwardly from net head curve 204A and intersects gross head curve 202A at a point 218A, which represents the operating point for turbine unit 1 if the trash rack were completely clean. As illustrated, turbine unit 1 is operating with a dirty trash rack and 37.25 feet of effective gross head and generating 28.2 MW of power, where it historically is 86.0% efficient. If, however, turbine unit 1 had a completely clean trash rack it would be generating the 28.2 MW of power with 42.85 feet total gross head, where it historically is 89.7% efficient.

Yet another preferable feature in view 200A is that data display area 206A shows the economic costs of operating turbine unit 1 at the current level rather than the most efficient level for both gross head curve 202A and net head curve 204A. In particular, the "current" data on the left side of the middle row shows that the extra cost of operating unit 1 with a clean trash at the current level (28.2 MW) instead of the most efficient level (24.0 MW) is $15,000 per year. By contrast, the "current" data on the right side of the middle row shows that the extra cost of operating unit 1 with the dirty trash rack at the current level instead of the most efficient level is substantially higher, i.e., $102,000 per year. Preferably, the time period for which the costs are displayed is user selectable, e.g., per hour, per day, per week, per month, and per year.

Another preferable feature in view 200A is a "what if" generator which determines the economic cost of operating turbine unit 1 at any operating point chosen by the operator. The "what if" generator is set by the operator by moving a short vertical bar 220A to a desired location on gross head curve 202A. As illustrated, "what if" bar 220A is presently set by the operator at a point just at the edge of cavitation for both curves. In view 200A, the safe operating range of turbine unit 1 on curves 202A and 204A is preferably indicated by a black line and the operating range beyond the cavitation limit is preferably indicated by a red line. Additionally, "what if" bar 220A and the associated "what if" data in the bottom row of data area 206A are preferably shown in some other color, such as blue. The "what if" data in the bottom row shows that at a power generation level of 26.2 MW, turbine unit 1 is 90.1% efficient with a clean trash rack (gross head curve 202A) but only 87.6% efficient with the current dirty trash rack (net head curve 204A). More importantly, the operator or automated control system can quickly determine and compare the economic impact in dollars of operating with the dirty trash rack instead of a clean trash rack at any point of operation. For example, the illustrated efficiency penalty at 26.2 MW is only $4,000 per year with a clean trash rack, but $42,000 per year with the dirty trash rack.

Accordingly, it should now be clear that views 100 and 200A provide different kinds of information, but both are useful to the operator who must make decisions based on the operating efficiencies of the turbine units or an automated control system performing similar functions. To summarize, view 100 shows only the cost of the current operation in terms of the trash loss. By contrast, view 200A gives a graphical indication of how much the head loss resulting from trash build-up has decreased the overall turbine operating efficiency. In particular, view 200A shows how much capacity and efficiency have been lost as well as how much the operating range has been narrowed. For example, an operator looking at curves 202A and 204A can see that the power generation capacity has gone down from about 34 MW to about 28 MW, and that the efficiency at maximum capacity has gone down as well. Moreover, the operator can see that efficiency at any given operating level has gone down dramatically, and that the best turbine efficiency has dropped in terms of available power load as well as efficiency. All of these are operational constraints and costs which are readily apparent to the operator looking at view 200A or an automated control system.

Figure 5B:
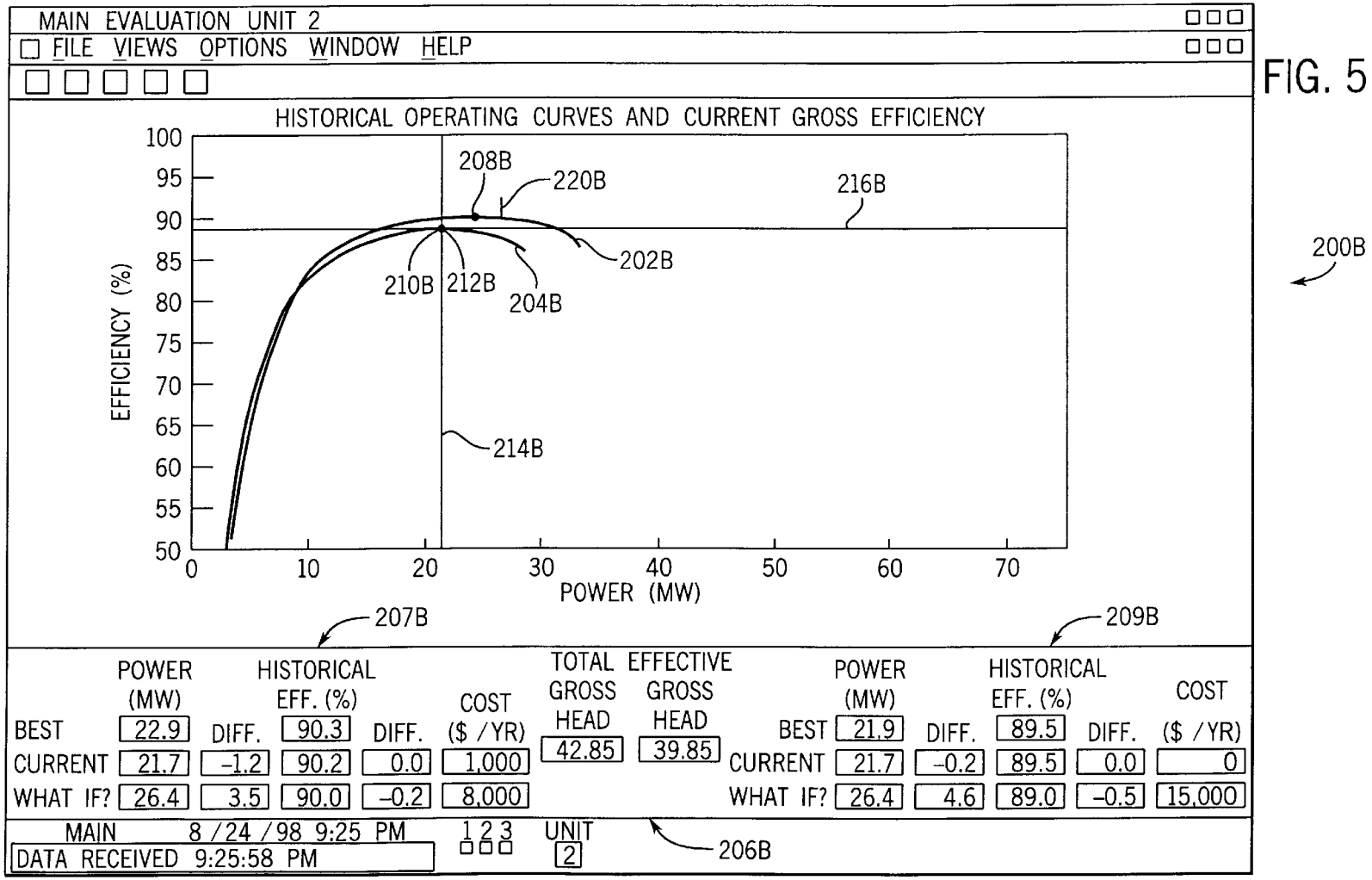
Figure 5C:
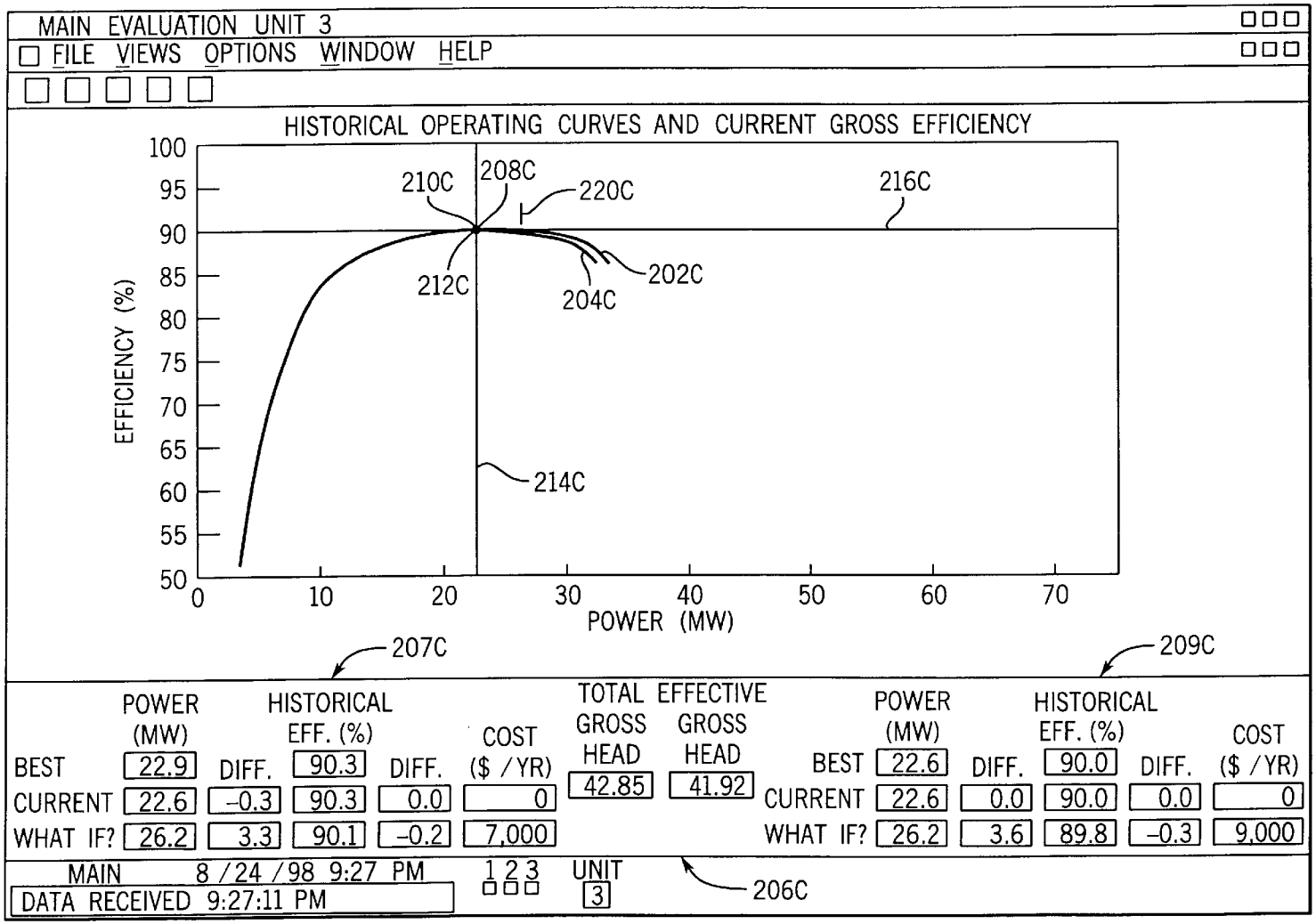

FIG. 5B shows a Main Evaluation Unit 2 view 200B, and FIG. 5C shows a Main Evaluation Unit 3 view 200C. Views 200B and 200C are similar to view 200A described above and differ therefrom only to the extent that the operating parameters and characteristics of turbine units 2 and 3 differ from the operating parameters and characteristics of turbine unit 1. Thus, performance curves 202B and 204B in FIG. 5B are selected from a series of operating curves as a function of head that are computed ahead of time for unit 2 and stored in memory 78. Similarly, performance curves 202C and 204C in FIG. 5C are selected from a series of operating curves as a function of head that are computed ahead of time for unit 3 and stored in memory 78. Data display areas 206B and 206C (FIGS. 5B and 5C, respectively) will also differ according to the specific operating parameters of respective turbine units 2 and 3.

From a comparison of views 200A, 200B and 200C, it should be clear that turbine unit 1 has the highest degree of trash rack fouling, that turbine unit 2 has a somewhat lower degree of trash rack fouling, and that turbine unit 3 has a relatively clean trash rack. This pattern of clogging is evidenced in the three views by the decreased amount of shifting between curves 202A and 204A (FIG. 5A), between curves 202B and 204B (FIG. 5B), and between curves 202C and 204C (FIG. 5C).

The present invention also includes a method for optimizing operation of a multi-unit hydro turbine facility to determine the best points to operate the turbine units, based on the net head curves. Thus, the optimization method takes into consideration the actual performance characteristics of the turbines rather than the apparent or presumed performance characteristics. Initially, a family of performance curves as a function of head is determined for each of the turbine units in the facility. As mentioned above, one of ordinary skill in the art will know how to generate such curves as a function of head for each of the turbine units. For example, the curves can be based on model test data, index test data, and/or absolute efficiency test data. Next, a head loss resulting from the accumulated trash on each turbine unit is determined as described above, and a net head is calculated for each turbine unit. Then, a net head performance curve is selected for each turbine unit based on the net head on that turbine unit. Based on the selected net head curves, an optimum power load distribution among the turbine units is then determined consistent with an optimization mode selected by the operator.

A number of optimization modes may be implemented in combination with the above-described method, including most efficient load, automatic generation control, maximum sustainable load, specific load, and specific flow. When the mode is set to most efficient load distribution, the optimization module selects the most efficient operating point for each of the turbine units at the actual net head of each turbine. For example, turbine unit 1 would be set to point 208A (FIG. 5A), turbine unit 2 would be set to point 208B (FIG. 5B), and turbine unit 3 would be set to point 208C (FIG. 5C). Thus, the base power achieved by the facility would be approximately 69.8 MW (=24.0+22.9+22.9). With automatic generation control mode, the operator sets a base megawatts objective for the facility as well as how much the turbines are allowed to swing on either side of that base. The optimization routine then selects the most efficient operating points for the turbine units to achieve that base megawatts. If the mode is set to maximum sustainable load, the optimization routine selects an operating point for each turbine unit at the maximum sustainable load point. For example, turbine unit 1 would be set to about 28 MW, turbine unit 2 would be set to about 22 MW, and turbine unit 3 would be set to about 33 MW. Thus, the maximum base megawatts with the turbine units having dirty trash racks is approximately 83 MW. However, the maximum sustainable load could be as high as about 102 MW if the trash racks were completely clean, i.e., each unit could generate about 34 MW at the illustrated total gross head with completely clean trash racks. Moreover, it should clear from views 200A, 200B and 200C, that an optimization scheme which attempts to operate at maximum sustainable load but fails to account for performance losses from trash clogging, will attempt to set the turbine units to operate at points beyond their present capabilities, thus leading to inefficiencies, premature wear, and possible catastrophic failure. In specific load mode, the optimization routine selects the most efficient operating points of the turbine units to achieve a specific power load for the facility. Similarly, in specific flow mode the optimization routine selects the most efficient operating points of the turbine units to achieve a specific flow rate through the facility.

Although a variety of embodiments have been particularly described, it should be understood that the above description is of preferred exemplary embodiments of the present invention, and that the invention is not limited to the specific forms described. For example, alternative or additional colors could be used in views 200A, 200B, 200C besides the red, black, blue and green. Additionally, the "what if" and "best" operating point symbols used in views 200A, 200B and 200C could be different, and the data displays could be rearranged to suit the operator. Moreover, other optimization methods besides those described above will be evident to those skilled in the art upon reviewing the text and figures disclosed herein. Such other constructions are, nevertheless, considered to be within the scope of this invention. Accordingly, these and other substitutions, modifications, changes and omissions may be made in the design and arrangement of the elements as disclosed herein without departing from the scope of the appended claims.

What is claimed is:

1. A method for optimizing performance in a hydroelectric power generation facility including one or more turbine driven power generating units, each turbine unit receiving flow through an upstream conduit and having a trash rack disposed upstream of the conduit to prevent debris from flowing into the unit, the method comprising the steps of:

(a) determining a net head for each turbine unit;

(b) selecting a net head performance curve for each turbine unit based on the net head associated therewith; and (c) deriving an optimum operating point for each turbine unit based on the selected net head performance curves.

2. The method of claim 1, wherein the net head performance curve for each unit is generated from a series of performance curves or data points stored in memory.

3. The method of claim 2, wherein each curve in the series of performance curves or data points is based on model test data, index test data, absolute efficiency test data, or any combination thereof.

4. The method of claim 1, wherein the one or more turbine units is at least two turbine units, and wherein the net head for each turbine unit is determined by monitoring a first parameter representative of head downstream of the trash rack, a second parameter representative of flow through the trash rack and the turbine unit, a third parameter representative of measured current tailwater elevation, and a fourth parameter representative of a sum of the flows through all of the turbine units which affect tailwater elevation.

5. A method for optimizing performance in a hydroelectric power generation facility including a plurality of turbine driven power generating units, each turbine unit receiving flow through an upstream conduit and having a trash rack disposed upstream of the conduit to prevent debris from flowing into the unit, the method comprising the steps of:

(a) determining a net head for each turbine unit;

(b) selecting a net head performance curve for each turbine unit based on the net head associated therewith; and (c) deriving an optimum operating point for each turbine unit based on the selected net head performance curves, wherein the optimum operating points are chosen to distribute power load among the units consistent with an optimization mode selected by an operator or a control system performing similar functions.

6. The method of claim 5, wherein the optimization mode selected by the operator or the control system is selected from most efficient load, maximum sustainable load, automatic generation control, specific load, and specific flow.

7. A method for optimizing performance in a hydroelectric power generation facility including a plurality of turbine driven power generating units, each turbine unit receiving flow through an upstream conduit and having a trash rack disposed upstream of the conduit to prevent debris from flowing into the unit, the method comprising the steps of:

(a) determining a net head for each turbine unit;

(b) selecting a net head performance curve for each turbine unit based on the net head associated therewith; and (c) deriving an optimum operating point for each turbine unit based on the selected net head performance curves, wherein the net head performance curve for each unit is generated from a series of performance curves or data points stored in memory, and wherein additional net head performance curves can be generated by scaling between the performance curves stored in memory.

8. A method for monitoring losses in a hydroelectric power generation facility, the facility including a turbine driven power generating unit receiving flow through an upstream conduit and a trash rack disposed upstream of the conduit to prevent debris from flowing into the unit, the method comprising the steps of:

(a) measuring a total gross head for the turbine unit, a head loss and head loss coefficient resulting from the debris and the trash rack, and a flow rate through the trash rack;

(b) determining an effective gross head from the total gross head, the head loss, and the flow rate;

(c) selecting a best performance curve based on the total gross head and an actual performance curve based on the effective gross head; and (d) providing the best performance curve and the actual performance curve to an operator interface for display or to an automated control system.

9. The method of claim 8, comprising the further step of visually indicating a best operating on each performance curve with a graphic symbol.

10. The method of claim 8, wherein an end portion of each performance curve extends past a cavitation limit of the turbine unit, and the method further comprises the step of drawing the end portion of the curve in red or other suitable color to denote the cavitation limit.

11. The method of claim 8, comprising the further steps of drawing one of the performance curves with a thick line and drawing the other of the performance curves with a thin line.

12. The method of claim 8, comprising the further step of providing a data display area on the operator interface for showing operating data corresponding to the performance curves.

13. The method of claim 12, comprising the further steps of grouping the data corresponding to the best performance curve in one area and grouping the data corresponding to the actual performance curve in another area.

14. The method of claim 12, wherein the data display area further shows economic losses due to head loss resulting from trash on the trash rack.

15. The method of claim 14, wherein the operator can set a time period for displaying the economic losses so that the losses are expressed in terms of dollars per hour, day, week, month, or year.

16. The method of claim 12, wherein the data display area further shows data associated with a best operating point on each curve, data associated with a current operating point on each curve, data associated with an operator selectable "what if" operating point on each curve, or any combination thereof.

17. The method of claim 16, wherein the data display area further shows an economic cost of operating at the current operating point on each curve instead of the best operating point, an economic cost of operating at the "what if" operating point on each curve instead of the best operating point, or any combination thereof.

18. The method of claim 8, wherein the facility includes a plurality of turbine driven power generating units, the method further comprising the step of displaying a best performance curve overlaid upon an actual performance curve for each of the turbine units.

19. A system for monitoring losses in a hydroelectric power generation facility, the facility including a turbine driven power generating unit receiving flow through an upstream conduit and a trash rack disposed upstream of the conduit to limit intrusion of debris into the unit, the system comprising:

a first sensor detecting a first parameter representative of head upstream of the trash rack and generating a first signal representative thereof;

a second sensor detecting a second parameter representative of head downstream of the trash rack and generating a second signal representative thereof;

a third sensor detecting a parameter representative of flow through the conduit and generating a third signal representative thereof; and a controller coupled to the first, second and third sensors, the controller processing the first, second and third signals and generating a first performance curve and a second performance curve, the first performance curve representative of turbine operation at the head upstream of the trash rack and the second performance curve representative of turbine operation at the head downstream of the trash rack.

20. The system of claim 19, wherein the controller is coupled to sensors for a plurality of units in the facility and generates upstream head and downstream head performance curves for each unit of the plurality of units.

21. A system for monitoring losses in a hydroelectric power generation facility, the facility including a turbine driven power generating unit receiving flow through an upstream conduit and a trash rack disposed upstream of the conduit to limit intrusion of debris into the unit, the system comprising:

a first sensor detecting a first parameter representative of head upstream of the trash rack and generating a first signal representative thereof;

a second sensor detecting a second parameter representative of head downstream of the trash rack and generating a second signal representative thereof;

a third sensor detecting a parameter representative of flow through the conduit and generating a third signal representative thereof;

a controller coupled to the first, second and third sensors, the controller processing the first, second and third signals and generating a first performance curve and a second performance curve, the first performance curve representative of turbine operation at the head upstream of the trash rack and the second performance curve representative of turbine operation at the head downstream of the trash rack; and an operator interface coupled to the controller, wherein the controller generates an output signal for commanding the operator interface to display the first and second performance curves overlaid on each other.

22. A system for monitoring losses in a hydroelectric power generation facility, the facility including a turbine driven power generating unit receiving flow through an upstream conduit and a trash rack disposed upstream of the conduit to limit intrusion of debris into the unit, the system comprising:

a first sensor detecting a first parameter representative of head upstream of the trash rack and generating a first signal representative thereof;

a second sensor detecting a second parameter representative of head downstream of the trash rack and generating a second signal representative thereof;

a third sensor detecting a parameter representative of flow through the conduit and generating a third signal representative thereof;

a controller coupled to the first, second and third sensors, the controller processing the first, second and third signals and generating a first performance curve and a second performance curve, the first performance curve representative of turbine operation at the head upstream of the trash rack and the second performance curve representative of turbine operation at the head downstream of the trash rack; and an automated control system, wherein the controller generates output signals representative of the performance curves and an optimized combination of turbine units to the automated control system.

* * * * *